US005374052A

United States Patent [19]

Folsom

[11] Patent Number: 5,374,052

[45] Date of Patent: Dec. 20, 1994

[54] CHANGE OF DIRECTION CONVEYANCE OF PAPER SHEETS OR BUSINESS FORMS

[75] Inventor: James C. Folsom, Sanford, Me.

[73] Assignee: Moore Business Forms, Inc., Grand Island, N.Y.

[21] Appl. No.: 175,766

[22] Filed: Dec. 30, 1993

[51] Int. Cl.[5] ..... B65H 5/00

[52] U.S. Cl. ..... 271/225; 198/457; 198/461; 271/240; 271/253; 271/184

[58] Field of Search ..... 271/225, 184, 253, 240, 271/234; 198/457, 461, 380

[56] References Cited

U.S. PATENT DOCUMENTS

| | | | |
|---|---|---|---|
| 2,093,937 | 9/1937 | Spiess | 271/52 |
| 2,498,061 | 2/1950 | Apgar | 271/184 |
| 2,665,633 | 1/1954 | Schubert | 271/225 X |
| 3,540,567 | 11/1970 | Keller | 198/457 X |
| 3,880,420 | 4/1975 | Martin | 271/184 |
| 4,367,997 | 1/1983 | Schweingruber | 414/38 |
| 4,456,242 | 6/1984 | Morin | 271/94 |
| 4,724,945 | 2/1988 | Martin | 198/412 |
| 4,842,125 | 6/1989 | Besemann | 198/457 |
| 4,877,234 | 10/1989 | Mandel | 271/225 |
| 4,909,374 | 3/1990 | Skrypalle | 198/371 |
| 4,927,133 | 5/1990 | Evans | 271/225 |
| 4,928,807 | 5/1990 | Auerbach | 198/379 |
| 4,967,899 | 11/1990 | Newsome | 198/411 |
| 4,971,304 | 11/1990 | Lofthus | 271/227 |
| 5,004,220 | 4/1991 | Dreschel et al. | 271/184 |
| 5,056,772 | 10/1991 | Kellum, III | 271/184 |
| 5,086,909 | 2/1992 | Powell, Jr. | 198/534 |
| 5,092,579 | 3/1992 | Tokoro et al. | 271/240 |
| 5,172,907 | 12/1992 | Kalisiak | 271/227 |
| 5,180,154 | 1/1993 | Malick | 271/2 |
| 5,253,863 | 10/1993 | Brewster, Jr. | 271/265 |

*Primary Examiner*—Robert P. Olszewski
*Assistant Examiner*—Carol L. Druzbick
*Attorney, Agent, or Firm*—Nixon & Vanderhye

[57] ABSTRACT

A direction of movement of substantially fiat elements, such as sheets or business forms, is changed about 90°, without rotation of the forms. Nip rolls receive the forms driven in a first direction and accelerate the forms to make them airborne until they hit an adjustable abutment on the opposite side of an endless belt conveyor from the nip rolls. The endless belt conveyor conveys the forms in a second horizontal direction substantially perpendicular to the first direction. The forms may be shingled when moved both in the first and second directions, or can be deshingled by controlling the aspect ratio of the forms, the ratio of speeds of the elements, and the degree of shingling.

22 Claims, 5 Drawing Sheets

FIG. 1
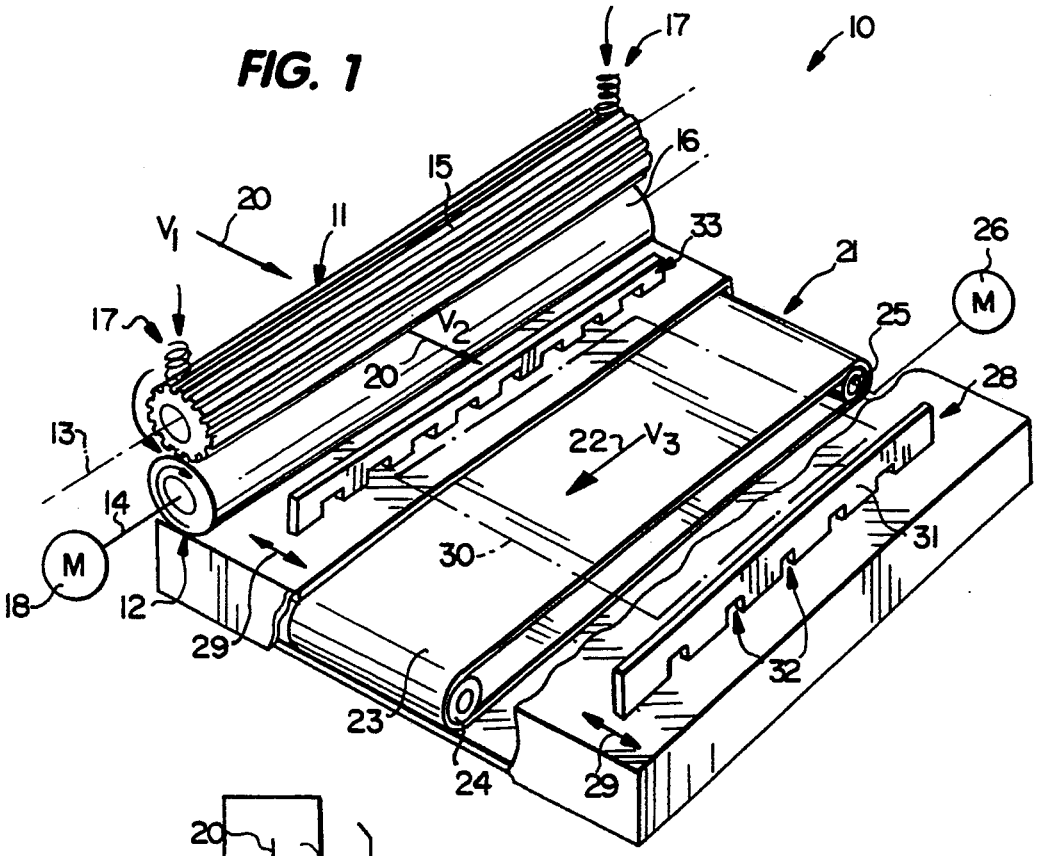
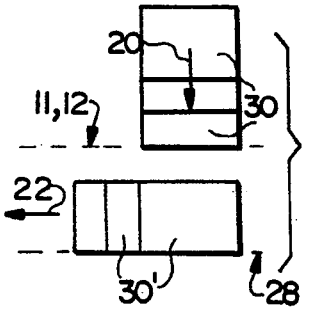
FIG. 2
FIG. 3A
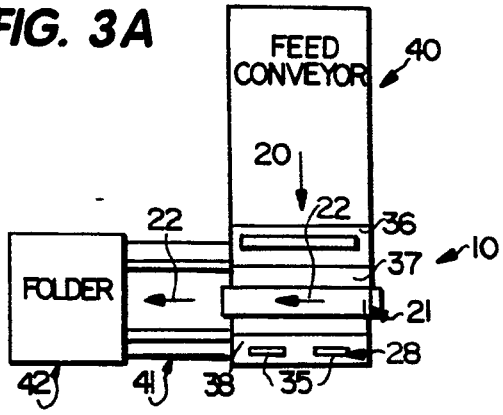
FIG. 3B
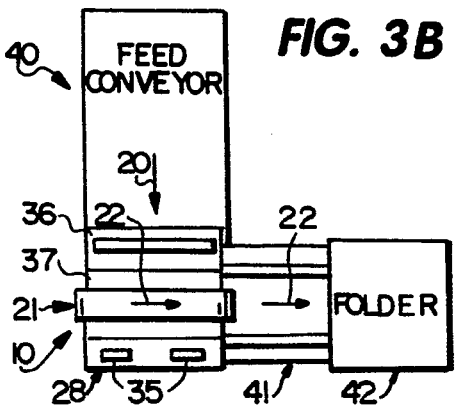

CHANGE OF DIRECTION CONVEYANCE OF PAPER SHEETS OR BUSINESS FORMS

BACKGROUND AND SUMMARY OF THE INVENTION

There are many circumstances in which it is desirable to change the direction of movement of paper sheets, business forms, or similar substantially planar elements. For example, in the transport of single ply sheets used to make business forms from a detacher to a folder, it is desirable to change the orientation of the sheets from landscape to portrait mode without the rotating forms, and typically for the forms to be shingled when moving in both modes. According to the present invention, an apparatus and a method are provided which readily accomplish this desirable result in a simple, versatile, and effective manner. The apparatus and method of the invention allow the sheets or forms to be moved at different and variable speeds in the different modes, moved in either horizontal substantially perpendicular direction to the initial direction of movement, and moved from a shingled configuration to a shingled configuration, or to be simultaneously deshingled, or even to be moved from a non-shingled configuration to a shingled configuration.

According to one aspect of the present invention, apparatus is provided for changing the direction of movement of substantially flat elements (like paper sheets or business forms, single or multiple ply). The apparatus comprises: First and second nip rolls each having a periphery, and mounted for rotation about first and second axes of rotation, the first and second axes substantially parallel to each other, and substantially horizontal with the first axis above the second axis, and the peripheries thereof substantially in engagement with each other, the nip rolls for driving a substantially flat element in a first direction substantially perpendicular to the first and second axes of rotation. Means for rotating the first and second nip rolls about the first and second axes of rotation. First conveying means for conveying sheets in a second direction substantially parallel to the first and second axes of rotation and substantially perpendicular to the first direction, and mounted below the first axis. And, abutment means mounted on the opposite side of the first conveying means from the nip rolls, and substantially parallel to the second direction, and positioned to stop movement of a substantially flat element in the first direction.

The abutment means may comprise at least one fence element and means for allowing passage of air past the fence element between ends of a substantially flat element impacting the abutment means in the second direction. For example, the air passage allowing means may comprise means defining air passages in the fence element. Alternatively or additionally the abutment means may further comprise means for adjustably mounting the fence element so that the position thereof with respect to the first conveying means may be readily adjusted to accommodate substantially flat elements of different dimension. For example, the abutment means may comprise a plurality of fence elements and means for adjustably mounting the fence elements so that the positions thereof with respect to the first conveying means may be readily adjusted to accommodate substantially flat elements of different dimension. A support surface substantially coplanar with the first conveying means may be provided, in which case the means for adjustably mounting the fence elements preferably comprise a permanent magnet associated with each fence element or support surface for holding each fence element in a position to which it has been placed on the support surface.

The first conveying means typically comprises an endless conveyor belt mounted on support rollers rotatable about axes of rotation substantially perpendicular to the first and second axes, and means for driving a support roller about its axis of rotation. Preferably, a bridge leads to a nip between the nip rolls for guiding a substantially flat element to the nip, and the first and second rolls, the first conveying means, and the abutment means are disposed in three different modules which may be connected to or disconnected from each other. There may also be a second abutment means mounted on the opposite side of the first conveying means from the first abutment means. Also, typically, the periphery of the first nip roll is grooved, and means are provided for biasing the first nip roll periphery toward the second nip roll periphery.

The apparatus as described above is typically used in combination with a second conveying means for conveying in the first direction substantially flat elements to the nip rolls, and third conveying means for conveying substantially flat elements away from the first conveying means in the second direction.

According to another aspect of the present invention, apparatus is provided for conveying substantially flat elements from movement in a first direction to movement in a second direction substantially transverse to the first direction, comprising the following components: A substantially horizontal first conveying means for conveying substantially flat elements in the second direction. Abutment means mounted on one side of the first conveying means. A second conveying means for conveying substantially flat elements in a first direction, the second conveying means mounted on the opposite side of the first conveying means from the abutment means. And, accelerating means mounted on the same side of the first conveying means as the second conveying means for receiving substantially flat elements from the second conveying means and accelerating the elements to propel the elements one at a time in the first direction over the first conveying means into engagement with the abutment means, so that the abutment means stops movement thereof in the first direction and causes the elements to move into operative engagement with the first conveying means.

The accelerating means preferably comprise the first and second nip rolls described above.

According to a method aspect of the present invention, there is provided a method of changing the direction (typically about 90 degrees of paper sheets or business forms, comprising the steps of substantially continuously: (a) Moving a paper sheet or business form in a first direction at a first speed. (b) Accelerating the paper sheet or business form while moving in the first direction to a second speed much higher than the first speed, sufficient to cause the paper sheet or business form to because completely airborne and move freely through the air. (c) Positively stopping movement of the airborne paper sheet or business form as it moves in the first direction. And, (d) immediately after step (c) moving the paper sheet or business form in a second direction substantially transverse to the first direction at a third speed.

The second speed is usually about 3–10 times higher than the first speed; for example, if the first speed is about 25 feet/minute when feeding single ply forms from a detacher to a folder, the second speed is about 190 feet/minute. Usually, the third speed is substantially greater than the first speed too; in the above example, the third speed could be about 170 feet/minute. The exact speeds, and ratios of speeds, will vary widely depending upon the particular sheets or forms, whether the forms are initially shingled and are to be maintained shingled or deshingled, the previous and subsequent operations to be performed on the sheets or forms, etc. For example the second speed can be from just higher than the first speed to about 360 feet/minute, while the third speed can be from zero to about 1,000 feet/minute.

According to optional methods of the invention, the paper sheets or business forms are moved in step (a) in a shingled configuration, and the degree of shingling and the aspect ratio of the sheets or forms and the ratio of the first to the third speed are controlled so that the sheets or forms are also shingled when moving in step (d), or deshingled when moving in step (d); or initially non-shingled forms moving at the first speed may be shingled when moving in step (d).

It is the primary object of the present invention to provide for the simple, effective, and versatile movement of substantially flat elements (like sheets or multiply or single ply business forms) from one direction to another generally transverse direction, without rotation of the elements. This and other objects of the invention will become clear from an inspection of the detailed description of the invention, and from the appended claims.

BRIEF DESCRIPTION OF THE DRAWINGS

FIG. 1 is a schematic perspective view of an exemplary embodiment of a basic apparatus according to the present invention:

FIG. 2 is a top schematic view showing the movement of shingled business forms from a first direction to a substantially transverse second direction according to a method of the present invention;

FIGS. 3A and 3B are top schematic views of various uses of apparatus according to the present invention in association with other pieces of sheet or forms handling equipment;

DETAILED DESCRIPTION OF THE DRAWINGS

Figure 4:
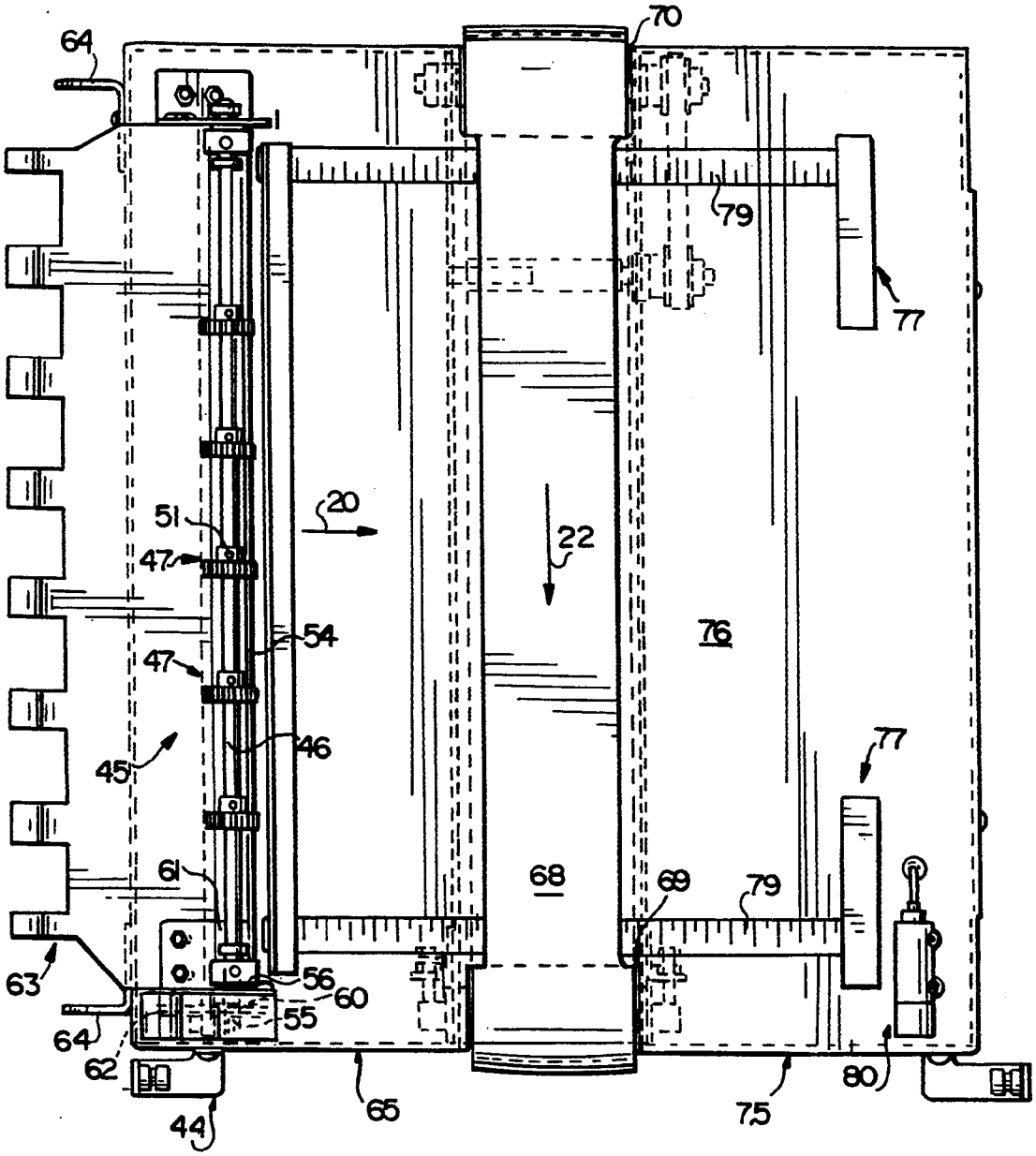
FIG. 4 is a top, more detailed, view of another modification of exemplary apparatus according to the present invention.
Figure 5:
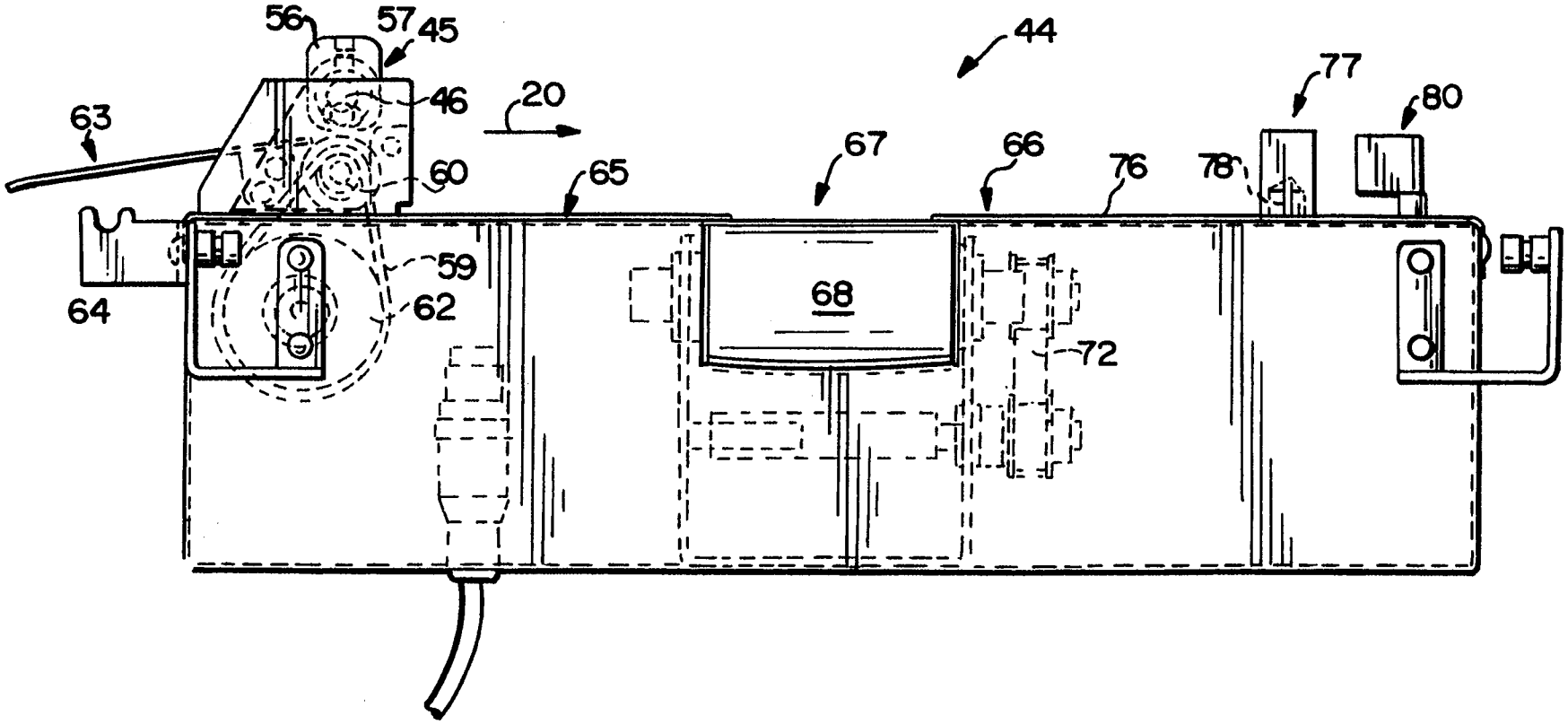
FIGS. 5 and 6 are side and end views respectively of the embodiment of FIG. 4.
Figure 6:
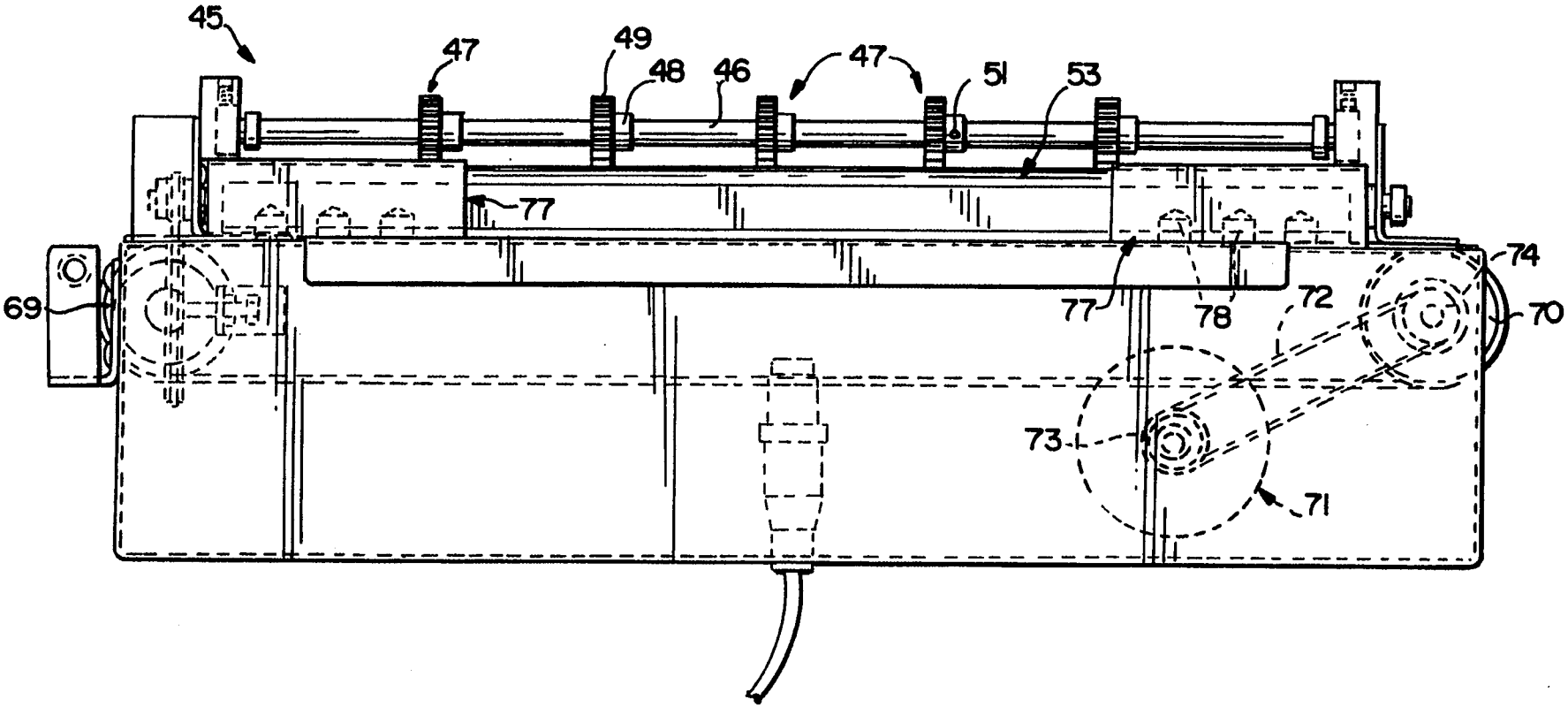
Figure 7:
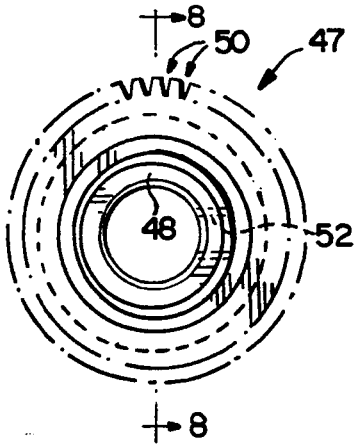
FIGS. 7 and 8 are front and side cross-sectional views, respectively, of the top roller of the nip rollers of the apparatus of FIGS. 1 and 4–6.
Figure 8:
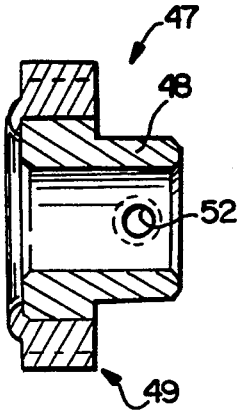

FIG. 1 schematically illustrates exemplary apparatus according to the present invention, shown generally by reference numeral 10. The apparatus includes first and second nip rolls 11, 12, respectively which are mounted for rotation about first and second axes of rotation 13, 14, respectively. The axes 13, 14 are substantially parallel to each other and substantially horizontal, and the first axis 13 is above the second axis 14. The peripheries 15, 16 of the rolls 11, 12 are typically biased into engagement with each other, or at least toward each other. For example, springs—shown schematically at 17 in FIG. 1—may be provided for biasing the first roll 11 downwardly toward the second roll 12. The rolls 11, 12 are driven about the axes 13, 14 by an electric motor 18 or like means for rotating the rolls, rotation of the roll 11 resulting in rotation of the roll 12 if they are biased into engagement, or accessory drive elements such as gears or pulleys being provided between them if the peripheries 15, 16 thereof are not biased into engagement.

The rolls 11, 12 receive a substantially flat element moving in a first direction 20 at a first velocity $V_1$, and then accelerating the element while continuing to move it in the first direction 20 to a velocity $V_2$. The velocity $V_2$ is sufficient to make the flat element airborne so that it completely clears the rollers 11, 12.

Disposed downstream of the rollers 11, 12 in the first direction 20 is a first conveying means 21. The first conveying means 21 moves elements supported thereby in a second direction 22, a horizontal direction perpendicular (or at least generally perpendicular) to the first direction 20 at a velocity $V_3$, the velocity $V_3$ having different values depending upon the particular type of substantially fiat elements being handled, whether the elements are to be shingled or deshingled, the prior or subsequent processing steps, etc. In the exemplary embodiment illustrated, the conveyor means 21 comprises an endless conveyor belt 23 mounted for movement about rollers 24, 25, the rollers 24, 25 rotatable about axes that are substantially parallel to the first direction 20 and thus perpendicular to the second direction 22. An electric motor 26 or the like rotates the roller 25, driving the top surface of the substantially horizontal endless belt 23 in the second direction 22.

Downstream of the first conveying means 21—on the opposite side thereof from the rollers 11, 12—is a first abutment means 28. The abutment means 28 preferably is adjustable in the first direction 20 as indicated by the arrows 29 in FIG. 1, depending upon the length of the planar element being handled, and has the sufficient height so that the planar element—such as the sheet of paper shown schematically in dotted line at 30 in FIG. 1—impacts it while airborne, and then drops into operative engagement with the first conveying means 21 (on top of the belt 23). The abutment means 28 illustrated in FIG. 1 comprises a single fence 31 having a plurality of air passages 32 therein to ensure that there is no significant back pressure of air formed by the sheet 30 moving into relatively high speed contact with the fence 31, that might cause the sheet 30 to be twisted or hindered in its movement.

As seen in FIG. 1 there is also an optional second abutment means 33 provided on the opposite side of the first conveying means 21 from the first abutment means 28, which second abutment means 33 may be substantially identical to the first abutment means 28, and which preferably also is adjustable as indicated by arrows 29 to accommodate sheets 30 of different lengths in the direction 20.

FIG. 2 illustrates a plurality of shingled paper sheets 30 (or single ply business forms) that are moving in the first direction 20 in landscape mode, and then ultimately are moved—also in shingled configuration—in the second direction 22 in portrait configuration, as illustrated by reference numerals 30' in FIG. 2, after moving into engagement with the abutment 28.

FIGS. 3A and 3B show utilization of the apparatus 10 in association with other pieces of equipment. The only difference between the apparatus 10 illustrated in FIGS. 3A and 3B and the apparatus 10 illustrated in FIG. 1 is that the abutment means 28 is provided by a pair of spaced fences 35, and the apparatus 10 is in the form of three modules, the first module 36 containing the nip rolls 11, 12 and a second abutment 33 if utilized, while the middle module 37 contains the first conveying means 21, and the third module 38 contains the fence elements 35.

In the particular embodiment illustrated in FIGS. 3A and 3B, twenty-eight pound pressure seal stock forms having dimensions of 8½ inches by 14 inches are being fed by a second conveying means 40, which in this case is part of a detacher (such as a Moore Business Forms Mode 3400 detacher). Downstream of the first conveyor means 21 in the second direction 22 is a third conveying means 41, which may be a Moore Business Forms Model 8155 conveyor. Downstream of the third conveying means 41 is the hopper of a folder 42, such as a Moore Model 8158 folder.

While the motor 26, and the particular drive of the endless belt 23 in general, may be made reversible, under some circumstances it is more expeditious and/or inexpensive to instead provide a unidirectional motor 26, and to detach and reattach the modules 36, 38 from the module 37, and completely rotate the module 37 180° about a vertical axis from the position illustrated in FIG. 3A to the position illustrated in FIG. 3B. Then the third conveying means 41 and the folder 42 are provided on the opposite side of the apparatus 10 from that illustrated in FIG. 3A, the direction 22 then being opposite the direction 22 in the FIG. 3A configuration.

FIGS. 4 through 10 show various details of the basic apparatus described above, for one particular embodiment of the invention. However a wide variety of modifications may be made to the apparatus as long as it has the most basic elements illustrated in FIG. 1.

The embodiment illustrated in FIGS. 4 through 10 is shown generally by reference numeral 44. The first nip roll is shown generally by reference numeral 45 in FIGS. 4 through 8. It comprises a shaft 46 having a plurality of spaced roller elements 47 thereon. A typical element 47 is shown in detail in FIGS. 7 and 8. The roller element 47 is known per se, comprising a nip wheel from a model 4600 heat sealer from Moore Business Forms. Element 47 comprises an aluminum collar 48 surrounded by shore A 55 durometer urethane 49 which has a plurality of grooves 50 therein. The collar 48 is held in any desired position to which it is moved along the shaft 46 by a set screw 51 (see FIG. 6) passing through a screw threaded opening 52 in the collar 48.

Figure 9:
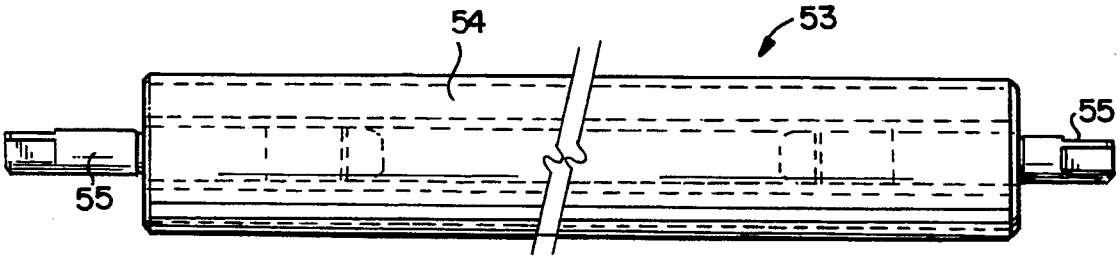
FIGS. 9 and 10 are side and end views, respectively, of the bottom roller of the nip rollers of the apparatus of FIGS. 1 and 4–6.
Figure 10:
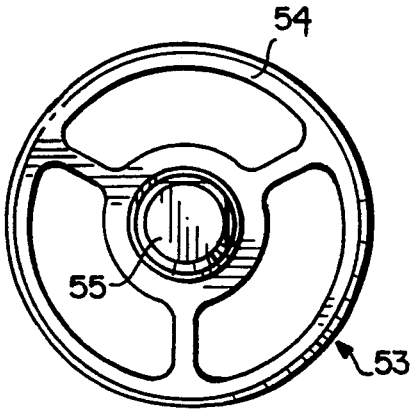

The second of the nip rollers 53 is shown most clearly in FIGS. 9 and 10, and comprises a primarily hollow metal roller shell or exterior 54 having journals 55 extending outwardly from the ends thereof. Brackets 56 are provided at opposite ends of the shaft 46, with a compression spring 57 in each bracket 56 (see FIG. 5) for biasing the shaft 46 downwardly so that the grooved periphery 50 of the rollers 47 into contact with the roller shell 54.

The lower roller 53 is driven by the drive belt 59 (see FIG. 5) which is connected between a pulley 60 attached to one of the journals 55, and a pulley 62 driven by a motor 61.

In order to ensure smooth movement of the substantially flat elements being conveyed by the rollers 45, 53 in the first direction 20 a bridge 63 (see FIGS. 4 and 5) is provided which leads the forms being fed by the previous element (e.g. conveyor 40) to the nip between the rollers 45, 53. Also, brackets 64 are also preferably provided to connect the module 65 of the apparatus 44 to the previous piece of equipment (e.g. conveyor 40).

Mounted in a center module 66 is the first conveying means 67, including the endless conveyor belt 68 which moves forms in a second direction 22, and is mounted at one end to roller 69, and at the other end to roller 70, the roller 70 being driven by the motor 71 (see FIG. 6) by a timing belt 72 connected between a pulley 73 on the motor 71 output shaft, and a pulley 74 connected to the journalled shaft for the roller 70.

The third module 75 of the apparatus 44 has a substantially flat top surface 76 which preferably is of steel or like magnetic material. Abutment means are mounted on the surface 76 which preferably is of steel or a like magnetic material. Abutment means are mounted on the surface 76, preferably comprising two (or more) spaced fence elements 77 which are adjustably positioned on the surface 76. Preferably adjustable positioning is provided by providing one or more (e.g. three) permanent magnets 78 (see FIGS. 5 and 6), the magnets 78 securely anchoring the fence element 77 in any position in which it is moved. In order to facilitate proper positioning of the fence element 77, a pair of scales 79 are provided extending in the first direction 20 adjacent the rollers 69, 70, preferably numerical indicia being associated with the scale 79 to indicate the width or length of the form or other substantially planar element that is to be handled by the apparatus 44. Since the scales 79 have the indicia thereon aligned exactly in the dimension 20, merely by positioning the fence elements 77 on particular indicia associated with the scales 79 the elements 77 are aligned.

Also mounted on the surface 76 preferably a sensor 80 is provided, on the end of the module 75 adjacent the roller 69. The sensor 80 may be of any suitable type, such as an optical sensor, and is for sensing jams at the end of the conveyor belt 68 in the direction 22 adjacent the roller 69.

Returning to the FIG. 1 embodiment, the speed $V_2$ is typically about 3–10 times higher than the speed $V_1$. For example if the speed $V_1$ is about 25 feet per minute when feeding single ply forms from a detacher to a folder, the second speed $V_2$ is about 190 feet per minute (and typically varies from speed $V_1$ up to about 360 feet per minute). Depending upon whether forms will remain shingled, be deshingled, the exact nature of the forms, etc., the speed $V_3$ is somewhere from 0 to about 1,000 feet per minute, for example about 170 feet per minute if forms 30, 30' as illustrated in FIG. 2 are both to be shingled. If it is desired to deshingle the forms, the aspect ratio of the forms should be close to one, and the forms delivered to the accelerating rolls 45, 53 should have less than the normal 70% shingling (of form depth) present at the in-feed. Typically the shingling should be about 35–60% of form length.

It will thus be seen that according to the present invention there is provided a simple, effective and versatile movement of substantially fiat elements (like paper sheets or multi-ply or single ply business forms) from one direction to another generally transverse direction, without rotation of the elements. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and methods.

What is claimed is:

1. Apparatus for changing the direction of movement of substantially fiat elements, comprising:

first and second nip rolls each having a periphery, and mounted for rotation about first and second axes of rotation, said first and second axes substantially parallel to each other, and substantially horizontal with said first axis above said second axis, and said peripheries thereof substantially in engagement with each other, said nip rolls for driving a substantially fiat element in a first direction substantially perpendicular to said first and second axes of rotation;

means for rotating said first and second nip rolls about said first and second axes of rotation;

first conveying means for conveying sheets in a second direction substantially parallel to said first and second axes of rotation and substantially perpendicular to said first direction, and mounted below said first axis;

first abutment means mounted opposite said first conveying means from said nip rolls, and substantially parallel to said second direction, and positioned to stop movement of the substantially fiat element in said first direction; and second abutment means mounted opposite said first conveying means from said first abutment means.

2. Apparatus as recited in claim 1 wherein said abutment means comprises at least one fence element and means defining air passages in said fence element.

3. Apparatus as recited in claim 2 further comprising means for adjustably mounting said fence element so that a position thereof with respect to said first conveying means may be readily adjusted to accommodate substantially flat elements of different dimension.

4. Apparatus as recited in claim 1 wherein said abutment means comprise a plurality of fence elements and means for adjustably mounting said fence elements so that positions thereof with respect to said first conveying means may be readily adjusted to accommodate substantially flat elements of different dimension.

5. Apparatus as recited in claim 4 further comprising a support surface substantially coplanar with said first conveying means, and wherein said means for adjustably mounting said fence elements comprise a permanent magnet associated with at least one of each fence element and support surface for holding each fence element in a position to which it has been placed on said support surface.

6. Apparatus as recited in claim 1 wherein said first conveying means comprises an endless conveyor belt mounted on support rollers rotatable about axes of rotation substantially perpendicular to said first and second axes, and means for driving at least one of said support rollers about its_axis of rotation.

7. Apparatus as recited in claim 1 further comprising a bridge leading to a nip between said nip rolls for guiding a substantially flat element to said nip.

8. Apparatus as recited in claim 1 wherein said first and second rolls, said first conveying means, and said abutment means are disposed in three different modules which may be connected to and disconnected from each other.

9. Apparatus as recited in claim 1 in combination with a second conveying means for conveying in said first direction substantially flat elements to said nip rolls, and third conveying means for conveying substantially flat elements away from said first conveying means in said second direction.

10. Apparatus as recited in claim 9 further comprising a bridge leading to a nip between said nip rolls for guiding a substantially flat element to said nip from said second conveying means.

11. Apparatus as recited in claim 10 wherein said periphery of said first nip roll is grooved, and further comprising means for biasing said first nip roll periphery toward said second nip roll periphery.

12. Apparatus as recited in claim 1 wherein said periphery of said first nip roll is grooved, and further comprising means for biasing said first nip roll periphery toward said second nip roll periphery.

13. Apparatus for conveying substantially flat elements from movement in a first direction to movement in a second direction substantially transverse to said first direction, comprising:

a substantially horizontal first conveying means for conveying substantially flat elements in said second direction;

abutment means mounted on a first side of said first conveying means;

a second conveying means for conveying substantially flat elements in a first direction, said second conveying means mounted on a second side of said first conveying means opposite from said abutment means; and accelerating means mounted on the second side of said first conveying means for receiving substantially flat elements from said second conveying means and accelerating the elements to propel the elements one at a time in said first direction over said first conveying means into engagement with said abutment means, so that said abutment means stops movement thereof in said first direction and causes the elements to move into operative engagement with said first conveying means.

14. Apparatus as recited in claim 13 wherein said accelerating means comprise first and second nip rolls each having a periphery, and mounted for rotation about first and second axes of rotation, said first and second axes substantially parallel to each other, and substantially horizontal with said first axis above said second axis, and said peripheries thereof substantially in engagement with each other.

15. Apparatus as recited in claim 13 further comprising a bridge element between said second conveying means and said accelerating means; and wherein said abutment means comprise a plurality of fence elements and means for adjustably mounting said fence elements with respect to said first conveying means to accommodate substantially flat elements of different dimension; and further comprising a support surface substantially coplanar with said first conveying means; and wherein said means for adjustably mounting said fence elements comprise a permanent magnet associated with at least one of each fence element on said support surface for holding each fence element in a position to which it has been placed on said support surface; and wherein said first conveying means comprises an endless conveyor belt mounted on support rollers rotatable about axes of rotation substantially perpendicular to said first and second axes, and means for driving a support roller about its axis of rotation.

16. A method of changing a direction of movement of paper sheets or business forms, comprising the steps of substantially continuously:

(a) moving a paper sheet or business form in a first direction at a first speed;

(b) accelerating the paper sheet or business form while moving in the first direction to a second speed much higher than the first speed, sufficient to cause the paper sheet or business form to because completely airborne and move freely through the air;

(c) positively stopping movement of the airborne paper sheet or business form as it moves in the first direction; and (d) immediately after step (c) moving the paper sheet or business form in a second direction substantially transverse to the first direction at a third speed.

17. A method as recited in claim 16 wherein the second speed is about 3–10 times higher than the first speed.

18. A method as recited in claim 16 wherein the third speed is substantially greater than the first speed.

19. A method as recited in claim 16 wherein the paper sheets or business forms have a degree of shingling and an aspect ratio and are moved in step (a) in a shingled configuration; and wherein the first and third speeds have a ratio; and wherein the degree of shingling and the aspect ratio of the sheets or forms and the ratio of the first to the third speed are controlled so that the sheets or forms are also shingled when moving in step (d).

20. A method as recited in claim 17 wherein the paper sheets or business forms have a degree of shingling and an aspect ratio and are moved in step (a) in a shingled configuration; and wherein the first and third speeds have a ratio; and wherein the degree of shingling and the aspect ratio of the sheets or forms and the ratio of the first to the third speed are controlled so that the sheets or forms are not shingled when moving in step (d).

21. A method as recited in claim 16 wherein the paper sheets or business forms are moved in step (a) in a non-shingled configuration, and wherein the speeds have ratios, and the ratios of the first to the third to the second speeds are controlled so that the sheets or forms are shingled when moving in step (d).

22. Apparatus for changing the direction of movement of substantially flat elements, comprising:

first and second nip rolls each having a periphery, and mounted for rotation about first and second axes of rotation, said first and second axes substantially parallel to each other, and substantially horizontal with said first axis above said second axis, and said peripheries thereof substantially in engagement with each other, said nip rolls for driving a substantially flat element in a first direction substantially perpendicular to said first and second axes of rotation;

means for rotating said first and second nip rolls about said first and second axes of rotation;

first conveying means for conveying sheets in a second direction substantially parallel to said first and second axes of rotation and substantially perpendicular to said first direction, and mounted below said first axis;

abutment means mounted opposite said first conveying means from said nip rolls, and substantially parallel to said second direction, and positioned to stop movement of the substantially flat element in said first direction, said abutment means comprising a plurality of fence elements and means for adjustably mounting said fence elements so that positions thereof with respect to said first conveying means may be readily adjusted to accommodate substantially flat elements of different dimension;

a support surface substantially coplanar with said first conveying means; and wherein said means for adjustably mounting said fence elements comprise a permanent magnet associated with at least one of each fence element and said support surface for holding each fence element in a position to which it has been placed on said support surface.

* * * * *